US006794646B2

(12) United States Patent
Tong et al.

(10) Patent No.: US 6,794,646 B2
(45) Date of Patent: Sep. 21, 2004

(54) METHOD AND APPARATUS FOR ATMOSPHERIC PRESSURE CHEMICAL IONIZATION

(75) Inventors: Roger Tong, Berkeley, CA (US); Gregory Wells, Fairfield, CA (US); Steven Schachterle, Martinez, CA (US)

(73) Assignee: Varian, Inc., Palo Alto, CA (US)

( * ) Notice: Subject to any disclaimer, the term of this patent is extended or adjusted under 35 U.S.C. 154(b) by 104 days.

(21) Appl. No.: 10/431,679

(22) Filed: May 8, 2003

(65) Prior Publication Data

US 2004/0099803 A1 May 27, 2004

Related U.S. Application Data

(60) Provisional application No. 60/428,802, filed on Nov. 25, 2002.

(51) Int. Cl.[7] ..... H01J 49/28

(52) U.S. Cl. ..... 250/288; 250/281; 250/182; 250/423 R; 250/424; 356/246

(58) Field of Search ..... 250/288, 281, 250/282, 423 R, 424; 356/246

(56) References Cited

U.S. PATENT DOCUMENTS 5,969,351 A * 10/1999 Nabeshima et al. ..... 250/288
2002/0074491 A1 * 6/2002 Fukuda ..... 250/288
2002/0125423 A1 * 9/2002 Ebeling et al. ..... 250/288

OTHER PUBLICATIONS

Atmospheric Pressure Chemical Ionisation from Internet http://crawfordscientific.com/opdac–course–examplechapter.pdf.

Atmospheric Pressure Chemical Ionization (APCI) Heated Nebulizer Ion Source from Internet PESciex "On–Line Documentation" CD. copyrighted 1996–97, Feb. 1997.

* cited by examiner

*Primary Examiner*—John R. Lee
*Assistant Examiner*—James J. Leybouren
(74) *Attorney, Agent, or Firm*—Bella Fishman; David Gloekler

(57) ABSTRACT

An apparatus for use as an ion source for mass analysis includes a nebulizing device, a vaporizing device, a chamber, an ion sampling structure, and an ionizing device. The vaporizing device includes a vaporizing interior that terminates at a vaporizing device outlet. The chamber fluidly communicates with the vaporizing device outlet. The ion sampling structure has an ion sampling inlet fluidly communicating with the chamber and spaced from the vaporizing device outlet. The ionizing device includes first and second electrodes positioned to produce an electrical discharge therebetween a location closer to the vaporizing device outlet than to the ion sampling inlet.

21 Claims, 10 Drawing Sheets

METHOD AND APPARATUS FOR ATMOSPHERIC PRESSURE CHEMICAL IONIZATION

RELATED APPLICATIONS

This application claims the benefit of U.S. Provisional Patent Application Ser. No. 60/428,802, filed Nov. 25, 2002.

FIELD OF THE INVENTION

The present invention generally relates to atmospheric pressure chemical ionization (APCI) in preparation for mass analysis, as is performed in mass spectrometry (MS). More particularly, the present invention relates to an apparatus and method for improving ionization of sample molecules in an APCI source.

BACKGROUND OF THE INVENTION

Mass spectrometry is a highly sensitive method of molecular analysis. In general, mass spectrometry is a technique that produces a mass spectrum by converting the components of a sample into rapidly moving gaseous ions, and resolving the ions on the basis of their mass-to-charge (m/e or m/z) ratios. The mass spectrum can be expressed as a plot of relative abundances of charged components as a function of mass, and thus can be used to characterize a population of ions based on their mass distribution. Mass spectrometry is often performed to determine molecular weight, molecular formula, structural identification, and the presence of isotopes. The apparatus provided for implementing mass spectrometry, i.e., a mass spectrometer (MS) system, typically consists of a sample inlet system, an ion source, a mass analyzer, and an ion detection system, as well as the components necessary for carrying out signal processing and readout tasks. Many of these functional components of the mass spectrometer, particularly the mass analyzer, are maintained at a low pressure by means of a vacuum system. The ion source converts the components of a sample into charged particles. The negative particles are ordinarily removed from the process flow in positive ion mode when analyzing positive particles. In negative ion mode the positive ions are removed. The mass analyzer disperses the charged particles based on their respective masses, and then focuses the ions on the detector. The ion currents produced by the detector are then amplified and recorded as a function of spectral scan time. The designs of the components of the mass spectrometer, and the principles by which they operate, can vary considerably. Thus, components of differing designs have distinct advantages and disadvantages when compared to each other, and the desirability of any one design can depend on, among other factors, the nature of the sample to be analyzed.

The sample inlet system employed for mass spectrometry can be chromatographic. That is, the effluent from a chromatographic column can be utilized as the sample source for the MS system. The mass spectrometer in such cases can be considered as serving as the detector for the chromatographic apparatus. Such an arrangement is commercially available in systems in which a gas chromatographic (GC) apparatus is directly coupled to the mass spectrometer (GC/MS systems), or a liquid chromatographic (LC) apparatus is directly coupled to the mass spectrometer (LC/MS systems). These combined systems are particularly useful for deriving complex spectra from mixtures, as it is known that mass spectrometers alone are more or less limited to handling pure compounds and relatively simple mixtures.

An ion source commonly serving as the interface between an LC apparatus and the mass spectrometer operates according to the principle of atmospheric pressure ionization (API), a soft ionization technique in which ionization of a sample occurs outside of the vacuum region or regions associated with the mass spectrometer. An increasingly popular type of API technique is atmospheric pressure chemical ionization (APCI or APcI). Simply stated, APCI is a means for ionizing samples (e.g., analyte molecules) dissolved in a liquid (e.g., an excess of mobile-phase molecules such as solvent). The sample-containing liquid emitted from the LC apparatus is pneumatically nebulized into a fine dispersion of numerous small droplets, typically below 100 microns in diameter. Heat is applied to the droplets to vaporize the liquid and sample matrix. This nebulization/vaporization process, however, is gentle enough to preserve the molecular identity of the sample constituents at this stage. The resulting gas/vapor is subsequently passed into a chamber where electrons emitted from an electrode generate a low-current corona discharge in the ambient, atmospheric-pressure environment consisting of, for example, a background gas such as nitrogen or air. The corona discharge ionizes the mobile-phase molecules to form an energetic chemical reagent gas plasma. In the corona discharge, ion-molecule reactions occur between the charge-neutral sample and the reagent ions formed in the primary discharge. The dominant mechanisms for the ion-molecule reactions are collisions between the reagent ions and the sample molecules, enabled by the relatively high (atmospheric) pressure environment, and charge transfer reactions. The ion-molecule reactions cause the sample to become charged, and the resulting stable sample ions are passed through an opening in a vacuum chamber into the mass analyzer of the mass spectrometer for mass analysis. Unlike the API technique of electrospray ionization (ES), in which multiple-charged molecular ions $[M+nH]^{n+}$ are produced, in most applications APCI produces only single-charged molecular ions typically in the form of $[M+H]^+$ or $[M-H]^-$ as a result of protonation or deprotonation.

FIG. 1 illustrates an example of a conventional APCI source, generally designated 10, utilized in, for example, an LC/MS system. In general terms, APCI source 10 comprises a sample introduction and nebulizing section, generally designated 20; a vaporization section, generally designated 30; an ionization section, generally designated 40; and an ion inlet section, generally designated 50. Ion inlet section 50 includes a front plate 52 having an ion inlet aperture 53 through which ionized products are directed into the mass analyzer of the mass spectrometer. For simplicity, the mass analyzer and other typical components of the mass spectrometer, such as its ion detection, signal processing and readout systems, are collectively designated as MS in FIG. 1.

Nebulizing section 20 comprises a capillary tube 23, typically a metal capillary, that serves as the sample inlet system of mass spectrometer MS. Capillary tube 23 conducts the LC column flow from a liquid chromatographic apparatus LC into vaporization section 30. In addition, a length of conduit 27 for directing a suitable inert nebulizing gas such as nitrogen into vaporization section 30 is coaxially disposed about capillary tube 23. Vaporization section 30 of APCI source 10 generally includes a vaporizing tube 33 and a heater 35 enclosed in a coaxial housing (not shown), and a conduit 37 for directing a suitable inert vaporizing ("auxiliary" or "make-up") gas such as nitrogen into vaporizing tube 33. Heater 35 is situated so as to ensure sufficient thermal contact with the wall of vaporizing tube 33. The wall of vaporizing tube 33 is typically quartz, and can operate at temperatures ranging from about 200–600° C. to rapidly vaporize effluent from capillary tube 23. While the thermal effect on typical samples is minimal, such a technique is not compatible with very thermally labile molecules. Capillary tube 23 is disposed along the central axis of vaporizing tube 33 and terminates at a capillary tube outlet 23A within vaporizing tube 33. A portion of vaporizing gas conduit 37 is coaxially disposed about nebulizing gas conduit 27 as well as capillary tube 23.

Ionization section 40 of APCI source 10 generally includes an ionization chamber 42 defining an enclosed volume into which a corona needle or pin 43 is inserted. Capillary tube 23 and conduits 27 and 37 are often integrated in a manifold structure which, along with vaporization section 30, is often structured as a probe that is mounted to ionization chamber 42. Corona needle 43 typically operates at about 5–10 kV and 1–5 mA to strike a low-current corona discharge or electron cloud 45 within ionization section 40. This electrical discharge 45 enables the generation of the afore-mentioned chemical reagent gas plasma utilized to ionize the sample molecules. Vaporizing tube 33 terminates at a vaporizing tube outlet 33A in fluid communication with ionization chamber 42, whereby vaporized analyte and mobile-phase constituents are transferred into chamber 42 for ionization. One or more voltage sources (not shown) are typically provided to impress a voltage between front plate 52 of ion inlet section 50 and one or more electrically conductive surfaces in ionization section 40 such as corona needle 43, thereby establishing one or more electric fields sufficient to attract ionized products derived from the vaporized LC eluent into ion inlet section 50 through ion inlet aperture 53.

In operation, a liquid sample comprising the LC column flow from liquid chromatographic apparatus LC is introduced into the heated vaporizing tube 33 via capillary tube 23, typically at a flow rate of about 0.1–2.0 ml/min. Nebulizing and vaporizing gas streams are introduced into vaporizing tube 33 through nebulizing gas conduit 27 and vaporizing gas conduit 37, respectively. The nebulizing gas flows concentrically around centrally disposed capillary tube 23 at a high velocity and a typical pressure of about 0.8 MPa, thereby nebulizing the liquid sample into small liquid droplets as the nebulizing gas and liquid sample enter vaporizing tube 33. Because the wall of vaporizing tube 33 is heated by heater 35 and consequently transfers heat energy into the interior of vaporizing tube 33, the liquid droplets of the nebulized sample entering vaporizing tube 33 are converted into vapor. The vaporizing gas is added to the system at a typical flow rate of about 1–3 L/min by means of vaporizing gas conduit 37. The flow of vaporizing gas assists in sweeping or transporting the liquid-droplet and vapor phases of the sample-containing aerosol through vaporizing tube 33. The resulting vapor temperature of the aerosol is about 100° C. The heated gas/vapor then passes in a sample exhaust stream 60 into chamber 42 and into the low-current corona discharge 45 established by corona needle 43 in ionization section 40, where the charge-neutral sample is ionized by ion-molecule reactions with the reagent ions formed in corona discharge 45.

In a typical configuration of conventional APCI source 10, corona needle 43 is oriented toward and in relatively close proximity with ion inlet aperture 53. Accordingly, a relatively large space or gap exists between vaporizing tube outlet 33A and the ionization volume defined by corona discharge 45. Moreover, corona discharge 45 is typically established by electrically coupling corona needle 43 with front plate 52 of ion entry section 50. As a result, vapor flow in ionization chamber 42 is characterized by an undesirably large volumetric time constant, which in turn results in a large-volume mixture of vapor-phase sample and vapor-phase background species (i.e., non-sample constituents). This mixture leads to an increase in the formation of background ions and in the splitting of peak components of the sample, a concomitant reduction in reaction volume and thus a reduction in sample ions, and an increase in chemical noise (i.e., a reduction in signal-noise ratio) and peak tailing or broadening as generated by mass spectrometer MS. In addition, corona needle 43 extends into sample exhaust 60 and thus is subject to contamination, especially at high flow rates.

It would therefore be advantageous to provide an ion source and ionization method that minimizes the amount of background vapor mixing with sample vapor, increases reaction volume, reduces the number of background ions entering a mass spectrometer, and reduces sample peak tailing. It would be further advantageous to-provide an ion source in which the electrode or electrodes employed are not directly exposed to the vaporizer discharge and to the chemical environment of the source chamber into which the contents of the vaporizing tube are exhausted.

The present invention is provided to address, in whole or in part, these and other problems associated with the prior art.

SUMMARY OF THE INVENTION

In general terms, the present invention provides an apparatus and method for ionizing a sample in preparation for mass analysis. The sample is first nebulized by pneumatic means and then vaporized by heating means. The vaporized sample is then ionized by directing the sample through an electrical discharge. The ionized sample is then directed toward the inlet section of an appropriate mass analysis device such as a mass spectrometer. The electrical discharge is formed at a location within the apparatus that enables the sample to be ionized without any significant mixing with background gases or vapors, and thus background noise and peak tailing are avoided or reduced during mass analysis. In some embodiments the electrical discharge has a DC potential, while in other embodiments the electrical discharge has an AC potential.

According to one embodiment, an apparatus for use as an ion source for mass analysis comprises a nebulizing device for nebulizing a flowing sample, a vaporizing device for vaporizing the sample flowing from the nebulizing device, a chamber, an ion sampling structure, and an ionizing device. The vaporizing device comprises a vaporizing interior that terminates at a vaporizing device outlet. The chamber fluidly communicates with the vaporizing device outlet. The ion sampling structure has an ion sampling inlet that fluidly communicates with the chamber and is spaced from the vaporizing device outlet. The ionizing device comprises first and second electrodes. The electrodes are positioned so as to produce an electrical discharge therebetween at a location closer to the vaporizing device outlet than to the ion sampling inlet.

In one aspect of this embodiment, the first electrode is positioned in the chamber in close proximity to the vaporizing device outlet. The second electrode is disposed within the vaporizing interior such that an electrical discharge is produced that extends into the vaporizing interior through the vaporizing device outlet. The second electrode can be a point-charge device such as a needle or pin, or can take the form of an electrically conductive portion of the nebulizing device or the vaporizing device. Alternatively, the second electrode is positioned in the chamber in the close proximity to the vaporizing device outlet opposite to the first electrode, such that the electrical discharge traverses a sample exhaust flow from the vaporizing device outlet. As another alternative, the first and second electrodes are disposed along an axial length of the vaporizing device outside of the vaporizing interior and are coupled by an AC voltage to produce an electrical discharge substantially entirely within the vaporizing interior. Preferably, the AC voltage is a high frequency voltage such as an RF voltage.

According to any of the embodiments described herein, the components of the apparatus serving as electrodes are positioned so as not to contact the sample in order to prevent contamination of the electrodes.

According to another embodiment, an apparatus for use as an ion source for mass analysis comprises a nebulizing device, a vaporizing device, a chamber, an ion sampling structure, and an ionizing device. The ionizing device comprises an electrode disposed in the chamber for creating an electrical discharge between the electrode and an electrically conductive component disposed in an interior of the vaporizing device. In one aspect, a DC voltage source is connected between the electrode and the conductive portion. In another aspect, an AC voltage source is connected between the electrode and the conductive portion.

According to yet another embodiment, an apparatus for use as an ion source or mass analysis comprises a nebulizing device, a vaporizing device, a chamber, an ion sampling structure, and a ionizing device. The ionizing device comprises first and second electrodes disposed in the chamber for creating an electrical discharge therebetween, across a sample exhaust flow received in the chamber from the vaporizing device, and proximal to an outlet of the vaporizing device into the chamber.

In one aspect of this embodiment, an RF voltage source is connected between the first and second electrodes. In another aspect, in addition to the RF voltage source, a DC voltage source is connected between one or both of the electrodes and the ion sampling structure for establishing an electrical field for directing sample ions toward an inlet of the ion sampling structure.

According to another embodiment, an apparatus for use as an ion source for mass analysis comprises a nebulizing device, a vaporizing device, a chamber, an ion sampling structure, and an ionizing device. The ionizing device comprises a first electrode disposed in the chamber approximate to an outlet of the vaporizing device, and a second electrode disposed in an interior of the vaporizing device. The configuration of these electrodes creates an electrical discharge through the vaporizing device outlet and into the interior of the vaporizing device.

According to another embodiment, an apparatus for use as an ion source for mass analysis comprises a nebulizing device, a vaporizing device, a chamber, an ion sampling structure, and an ionizing device. The ionizing device comprises a first and second electrodes that are driven by a RF voltage. The first and second electrodes are disposed outside of the interior of the vaporizing device along a length of the vaporizing device for creating an electrical discharge substantially entirely within the interior. In one aspect of this embodiment, an additional, polarizing electrode is disposed in the chamber for establishing an electrical field by which ionized sample components can be directed toward an inlet of the ion sampling structure.

A method is provided for ionizing sample molecules at atmospheric pressure, comprising the following steps. A nebulized sample is flowed through an interior of a vaporizing device to vaporize the sample. The vaporized sample is exhausted through an outlet of the vaporizing device into a chamber. An ion sampling inlet is disposed in the chamber and is spaced from the vaporizing device outlet. The sample is ionized by forming an electrical discharge at a location that is closer to the vaporizing device outlet than to the ion sampling inlet.

In one aspect of this method, at least a portion of the electrical discharge is directed through the vaporizing device outlet into the vaporizing device interior to initiate ionizing reactions prior to the sample being exhausted into the chamber. In another aspect, the sample is exhausted into the chamber in a sample exhaust stream and the electrical discharge traverses the sample exhaust stream at a location immediately downstream from the vaporizing device outlet. The sample becomes ionized immediately after being exhausted from the vaporizing device outlet. In a further aspect, the electrical discharge is formed substantially and entirely within the vaporizing device interior to initiate ionizing reactions prior to the sample being exhausted into the chamber.

DETAILED DESCRIPTION OF THE INVENTION

Figure 2A:
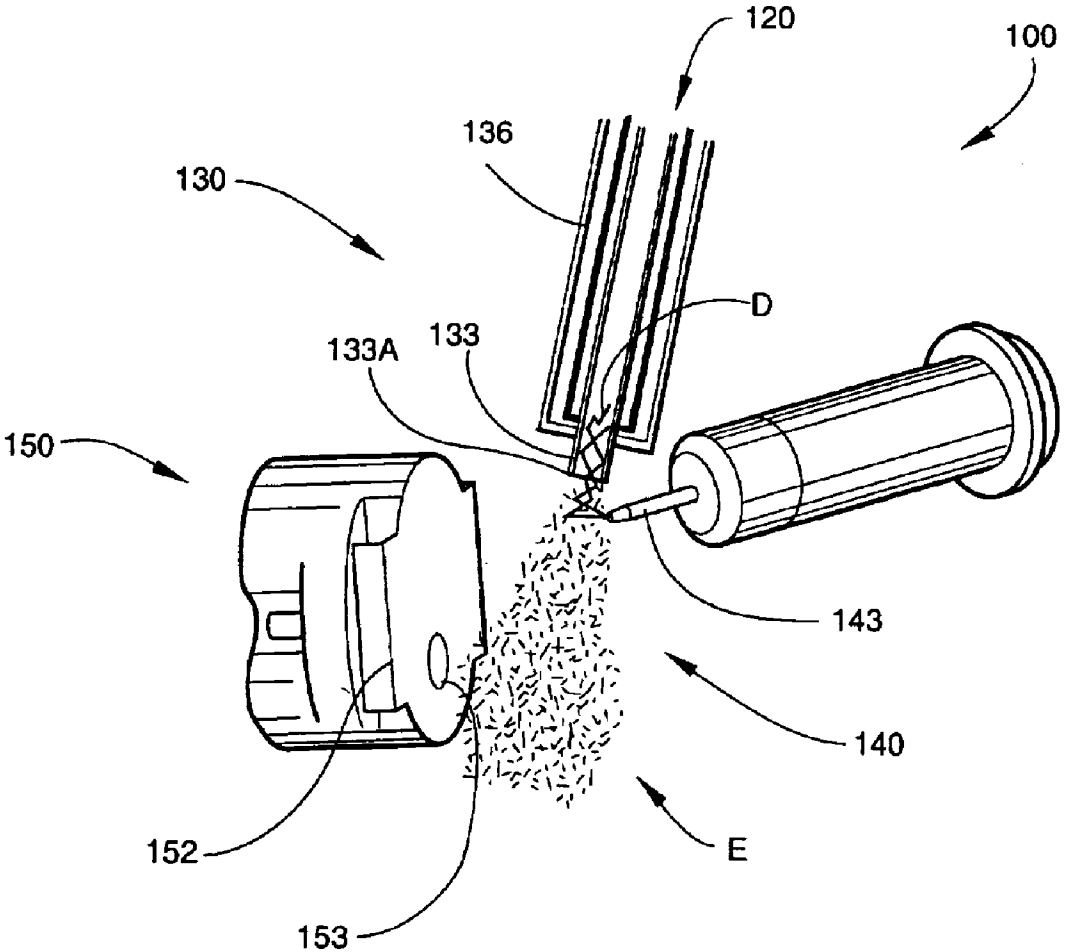
FIG. 2A is a perspective view of an APCI source provided in accordance with one embodiment of the present invention.
Figure 2B:
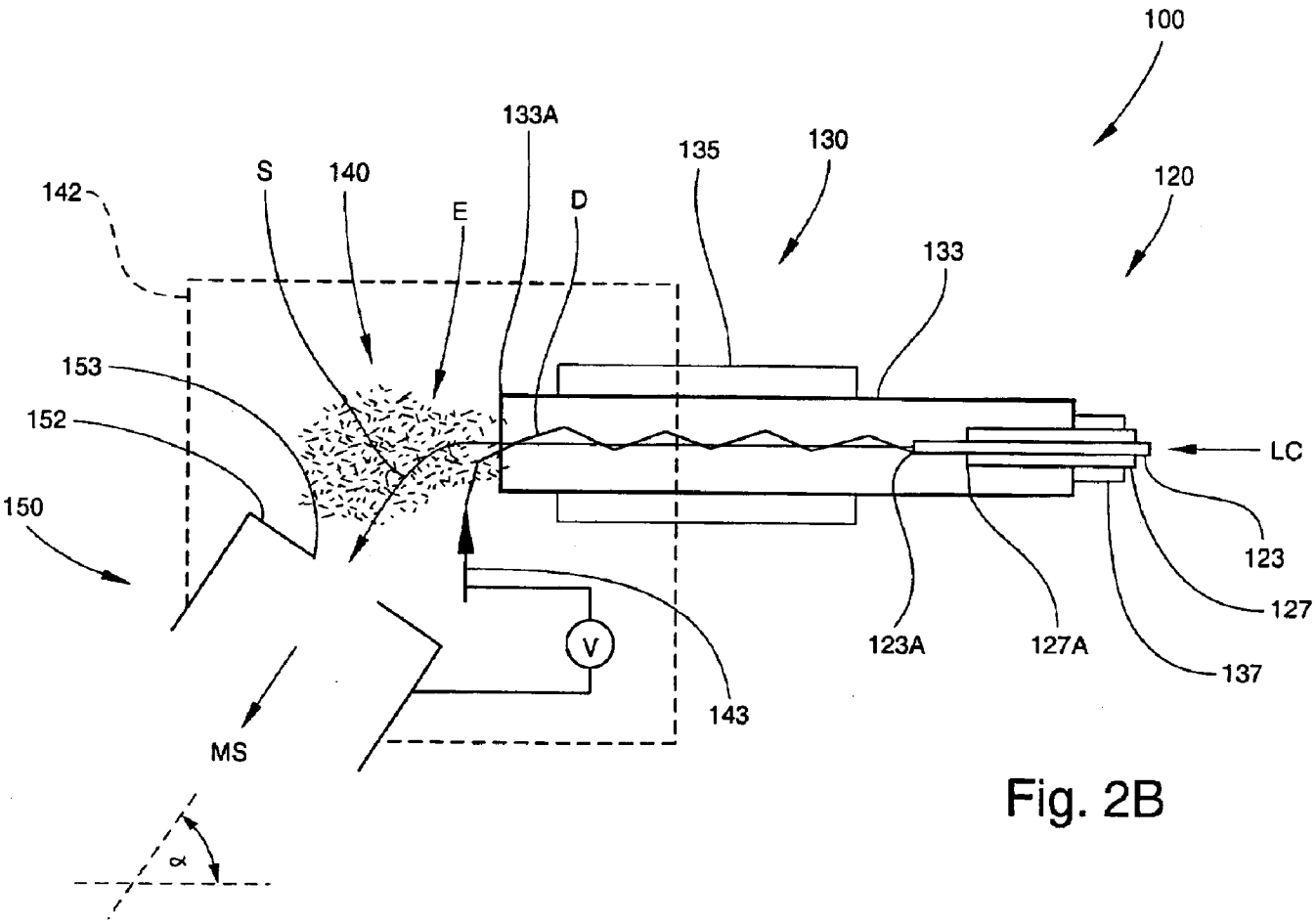
FIG. 2B is an axial cross-sectional schematic view of the APCI source shown in FIG. 2A.

Referring to FIGS. 2A and 2B, an APCI source, generally designated 100, is illustrated in accordance with one embodiment of the present invention. APCI source 100 finds particular use as an interface between a liquid chromatographic apparatus LC and a mass spectrometer MS. The invention, however, is not limited to the use of an LC instrument or any other particular input source of sample analytes to be ionized and processed by mass spectrometer MS. APCI source 100 comprises a sample introduction and nebulizing section or device, generally designated 120; a vaporization section or device, generally designated 130; an ionization section or device, generally designated 140; and an ion entry section or device, generally designated 150, including a front plate or wall 152. Front plate 150 has an ion sampling inlet 153 through which ionized products from a sample exhaust flow, generally designated E, are directed into mass spectrometer MS. Ion sampling inlet 153 can be an orifice or a conduit. As appreciated by persons skilled in the art, the structures defining the interface between ionization section 140 of APCI source 100 and ion entry section 150 are configured (such as through the use of appropriate flanges, seals, fasteners, and so on) to maintain a vacuum environment within mass spectrometer MS and an atmospheric or near-atmospheric pressure environment within APCI source 100.

Nebulizing section 120 comprises a sample conduit 123, preferably in the form of a capillary tube, for introducing a sample-containing solution from an appropriate source such as a liquid chromatographic apparatus LC. Sample conduit 123 is disposed generally along the central axis of a vaporizing tube 133, and terminates at a sample conduit outlet 123A that serves as the inlet for introducing the sample-containing solution directly into vaporizing tube 133. Nebulizing section 120 also comprises a conduit 127 for directing a suitable inert nebulizing gas such as nitrogen into vaporizing tube 133. Nebulizing gas conduit 127 terminates at a nebulizing gas conduit outlet 127A positioned to conduct nebulizing gas into vaporizing tube 133 in the vicinity of the point of entry of the sample-containing solution emitted from sample conduit 127, and thus to efficiently nebulize the sample-containing solution. Nebulization is preferably accomplished by positioning nebulized gas outlet 127A concentrically around sample outlet 123A of sample conduit 123. Sample conduit outlet 123A and nebulizing gas conduit outlet 127A can be structured as concentric orifices or as a nozzle. The path of the nebulized sample analyte components as they are nebulized, vaporized, ionized, and directed toward ion entry section 150 is schematically indicated in FIG. 2B by a line S. It will be understood, however, that the path of the sample as it flows through vaporizing tube 133 is not necessarily linear and can involve vortical components, and that means can be provided to force a vortical or otherwise non-linear flow if desired to enhance vaporization.

Vaporization section 130 comprises a structure suitable for defining an interior space through which the nebulized sample can travel to ionization section 140 and be efficiently vaporized prior to reaching ionization section 140. Accordingly, FIG. 2 illustrates a vaporizing space-defining structure provided in the form of vaporizing tube 133, although the invention is not limited to providing a tube-like or cylindrical profile. Vaporization section 130 can further comprise a heater 135 (FIG. 2B) of any suitable type (e.g., resistive elements, inductive coils, or the like) disposed in thermal contact with the wall of vaporizing tube 133. Heater 135 is enclosed in an outer housing 136 (FIG. 2A) of vaporization section 130. Heater 135 can operate according to a pre-determined temperature profile, and vaporizing tube 133 can have a specified axial length, for the purpose of maximizing vaporization of the contents of vaporizing tube 133. If desired, a sample pre-heating device (not shown) could also be included in vaporization section 130 or nebulizing section 120. A conduit 137 coaxial with nebulizing gas conduit 127 and capillary tube 123 supplies a flow of a suitable inert vaporizing gas such as nitrogen to assist in transporting the nebulized sample components through vaporizing tube 133. Vaporizing tube 133 terminates at a vaporizing tube outlet 133A that serves as the vaporized sample inlet into an ionization chamber 142. While the axis of ion sampling inlet 153 can be in-line with the axis of vaporizing tube outlet 133A, it is preferable that these two axes either be parallel and offset to each other or oriented at an angle $\alpha$ to each other. Angle $\alpha$ can be any value between 0 and 90°, and in one exemplary embodiment is 74°. The offset or angled orientation of vaporizing tube outlet 133A relative to ion sampling inlet 153 prevents large droplets that are not fully vaporized or ionized and background gas from entering ion entry section 150. This in turn reduces contamination of mass spectrometer MS, peak tailing, and background noise.

Figure 1:
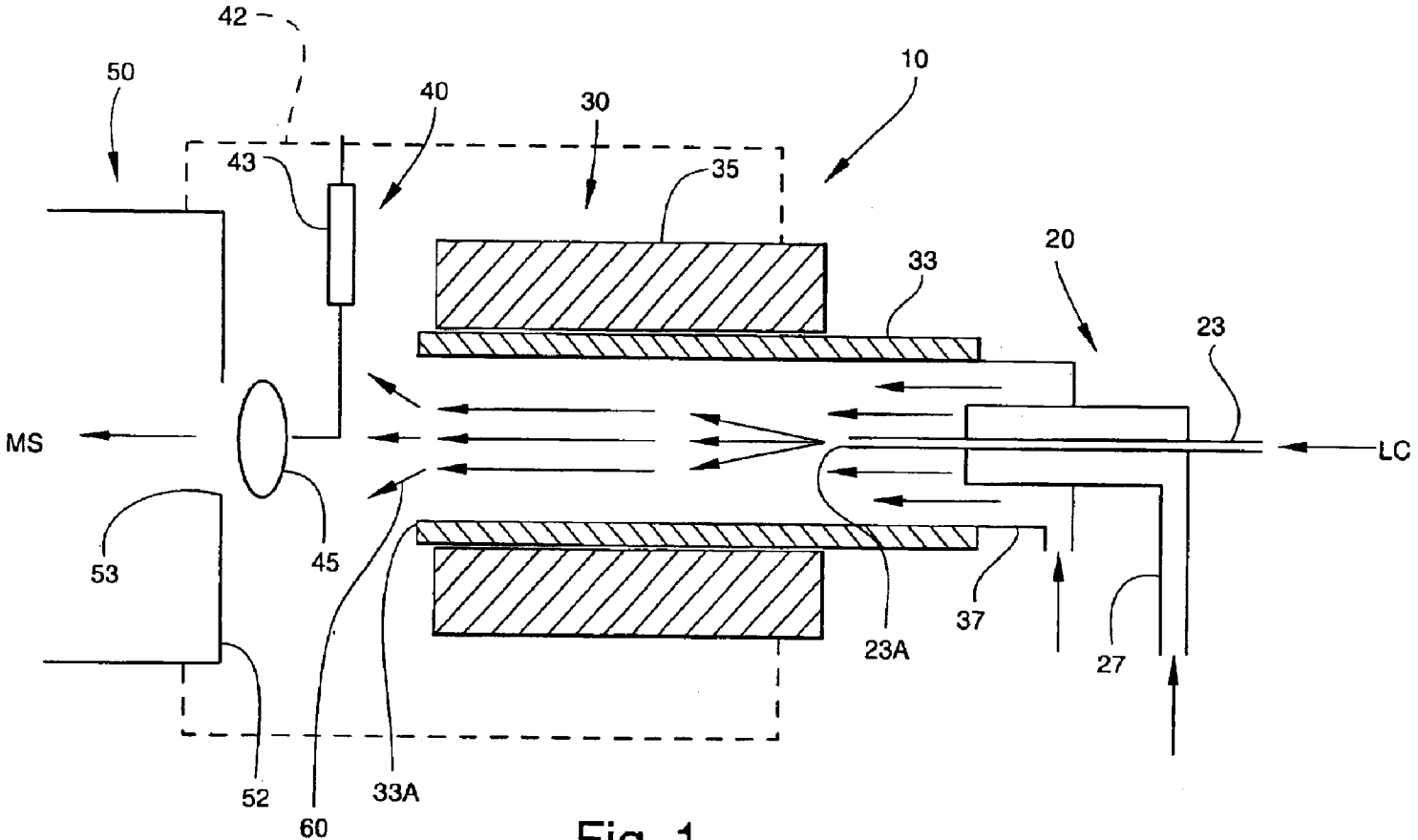
Fig. 1 (Prior Art)
FIG. 1 is an axial cross-sectional schematic view of a conventional APCI source.

Similar to the conventional system illustrated in FIG. 1, ionization section 140 of APCI source 100 generally includes an enclosed chamber (ionization chamber 142) into which an electrode 143, such as a corona needle or other point-charge supply means, is inserted to strike a low-current corona discharge D. At least one voltage source V is connected between corona needle 143 and front plate 152 or some other proximal, electrically conductive portion of ion inlet section 150 (at ground or some other reference potential) to establish an electric field (typically at a DC potential) suitable for directing ionized sample products toward front plate 152 and through ion sampling inlet 153 for introduction into mass spectrometer MS.

Unlike the conventional system, however, electrode 143 is not positioned near or coupled with front plate 152. Instead, electrode 143 is positioned close enough to vaporizing tube outlet 133A to enable the establishment of a voltage potential of, for example, approximately 1–approximately 6 kV, between electrode 143 and an electrically conductive portion of nebulizing section 120 that is grounded or at some other suitable reference voltage. For example, capillary tube 123 can be constructed from a metal and serve as a counter-electrode that becomes coupled with electrode 143 upon the energizing of electrode 143. As a result, electrical discharge D, or at least a portion thereof, is created in vaporizing tube 133 as illustrated in FIGS. 2A and 2B, and travels from electrode 143 to capillary tube 123 or other portion of nebulizing section 120. This electrical discharge D ionizes the vaporized or vaporizing constituents residing within vaporization tube 133. The reagent ions needed for chemical ionization are created mostly in vaporizing tube 133 and in sample exhaust E just outside of vaporizing tube outlet 133A. In some cases, ionization of at least some of the sample molecules through collision with the reagent ions can also occur within vaporizing tube 133.

As another advantage of this configuration, the amount of background vapor mixing with the sample vapor is minimized, because all or virtually all sample molecules are ionized before or in the immediate vicinity of vaporizing tube outlet 133A and thus can be immediately attracted to ion sampling inlet 153 without first recirculating with background gas in ionization chamber 142. This in turn minimizes ionization of background vapor components and thus reduces the number of background ions that enter mass spectrometer MS. In effect, the volumetric time constant for APCI source 100 is reduced with this configuration. Another advantage is that sample tailing is reduced, and thus the quality of data produced by mass spectrometer MS is improved. In addition, the creation of discharge D along the axial length of vaporizing tube 133 is believed to increase the reaction volume for chemical ionization, in effect extending the ionization region into vaporizing tube 133. Also, the close proximity of electrode 143 to vaporizing tube outlet 133A enables electrode 143 to be positioned outside of sample exhaust stream E, thereby preventing contamination of electrode 143.

In one example of the embodiments illustrated herein, vaporizing tube 133 is 4.5 mm in inside diameter and 50 mm in length, and has a volume of approximately 0.8 ml. If auxiliary gas (e.g., nitrogen) is flowed through vaporizing tube 133 from conduit 137 at a rate of approximately 2 L/min, a volumetric time constant of approximately 0.02 second is obtained, which is a much lower volumetric time constant than is obtained by conventional APCI or ESI sources.

Other embodiments yielding similar advantages will now be described with reference to FIGS. 3A–6C. These other embodiments can share many common features with APCI source 100 of FIGS. 2A and 2B. Common features thus are designated by like reference numerals, and only the primary differences between the embodiments are described further. For simplicity, heater 135 and ionization chamber 142 are not shown in FIGS. 3A–6C.

Figure 3A:
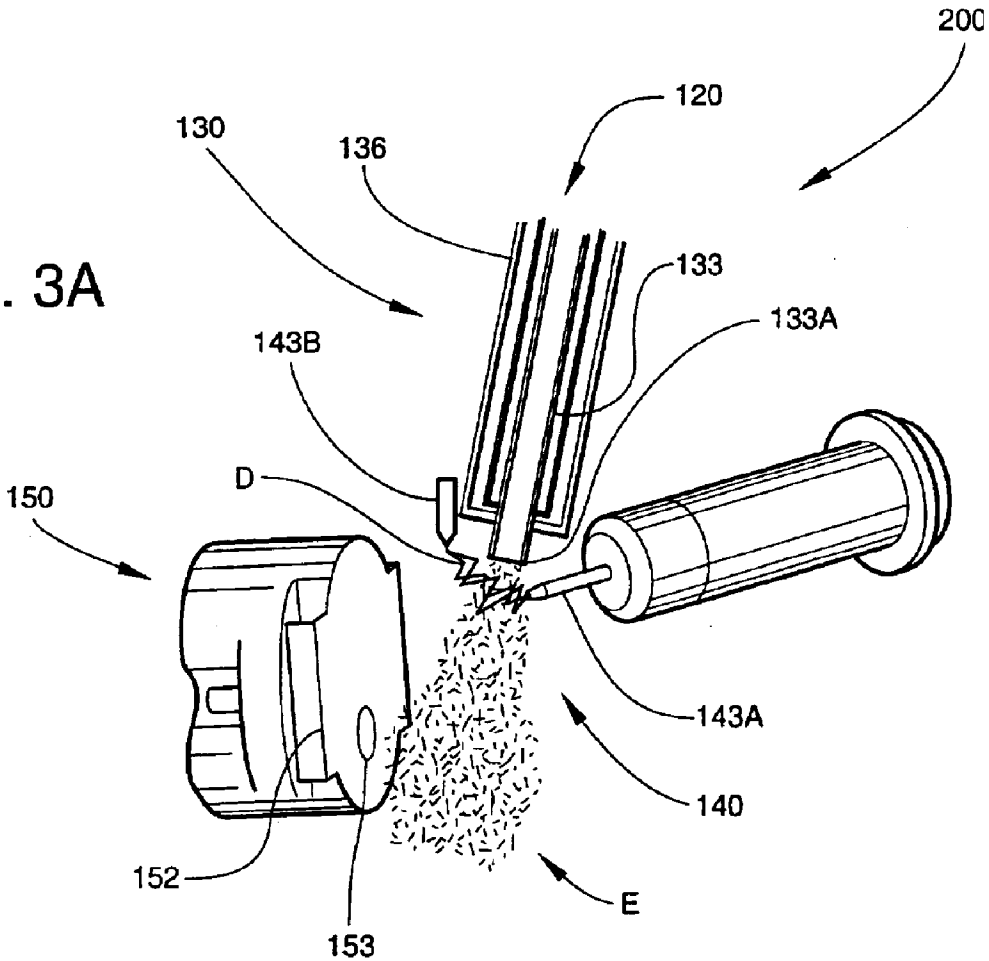
FIG. 3A is a perspective view of an APCI source provided in accordance with another embodiment of the present invention.
Figure 3B:
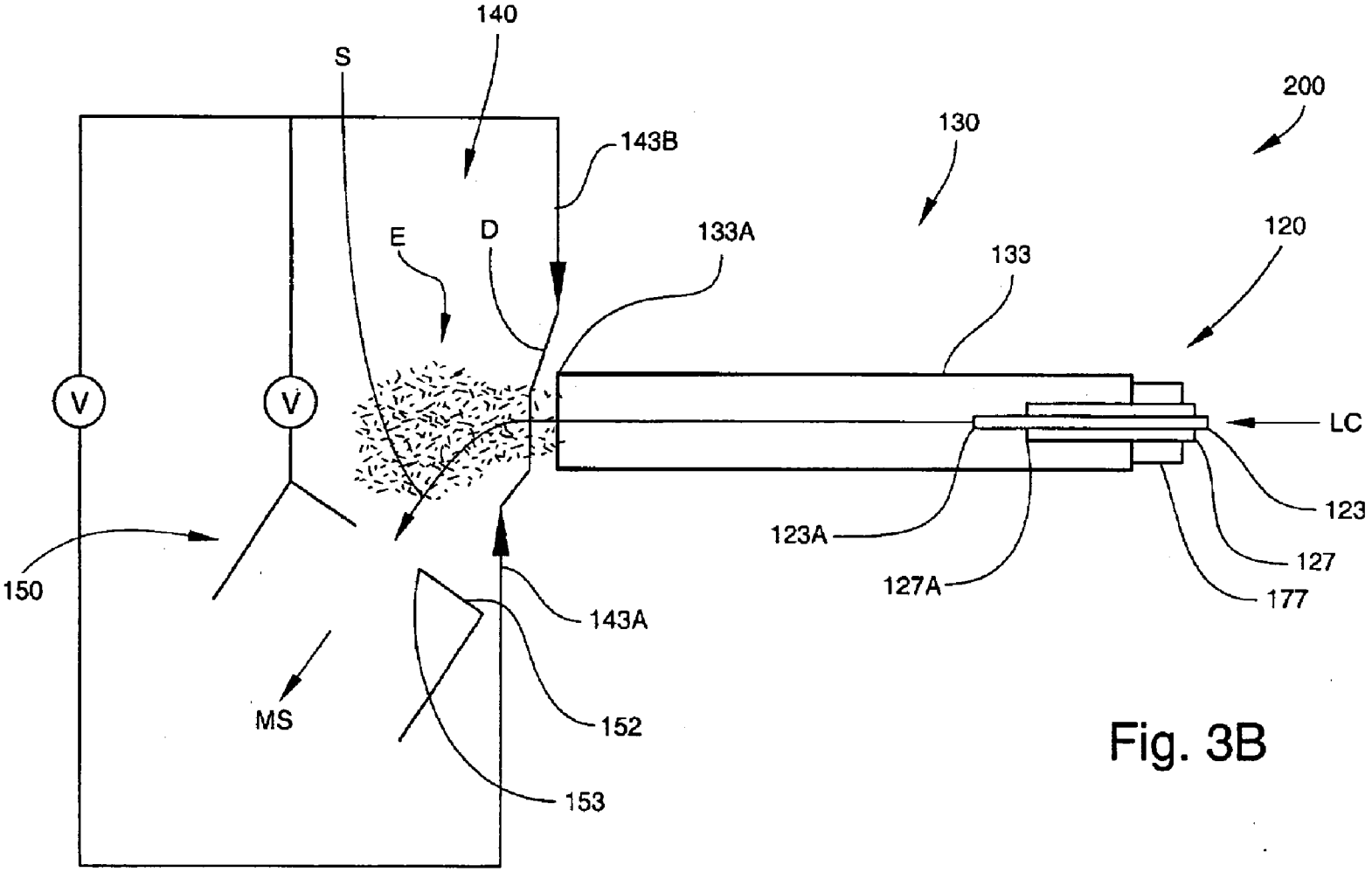
FIG. 3B is an axial cross-sectional schematic view of the APCI source shown in FIG. 3A.

Referring now to FIGS. 3A and 3B, an APCI source, generally designated 200, is illustrated according to another embodiment. In addition to a first electrode 143A such as a corona needle, APCI source 200 comprises a second electrode or counter-electrode 143B. Counter-electrode 143B can be structured similarly to first electrode 143A, or can be any electrically conductive structure provided with vaporization section 130 or ionization section 140 near vaporizing tube outlet 133A. Both electrodes 143A and 143B and thus the ionization region are located downstream of vaporizing tube 133 and just outside of vaporizing tube outlet 133A. As schematically illustrated in FIG. 3B, one or more DC voltage sources V are provided as necessary to initiate a corona discharge between electrodes 143A and 143B, as well to couple one or both electrodes 143A and 143B with a suitable surface of ion entry section 150 to direct sample ions from sample exhaust flow E into ion sampling inlet 153. As a result, electrical discharge D traverses vaporizer exhaust stream E from electrode 143A to counter-electrode 143B in the immediate vicinity of vaporizing tube outlet 133A. Because electrical discharge D is located in close proximity to vaporizing tube outlet 133A, the effective ionization region is confined to this area. Consequently, the volume in which background vapors can mix with sample vapor is small, with the advantage that background ions and peak tailing are minimized.

Figure 4:
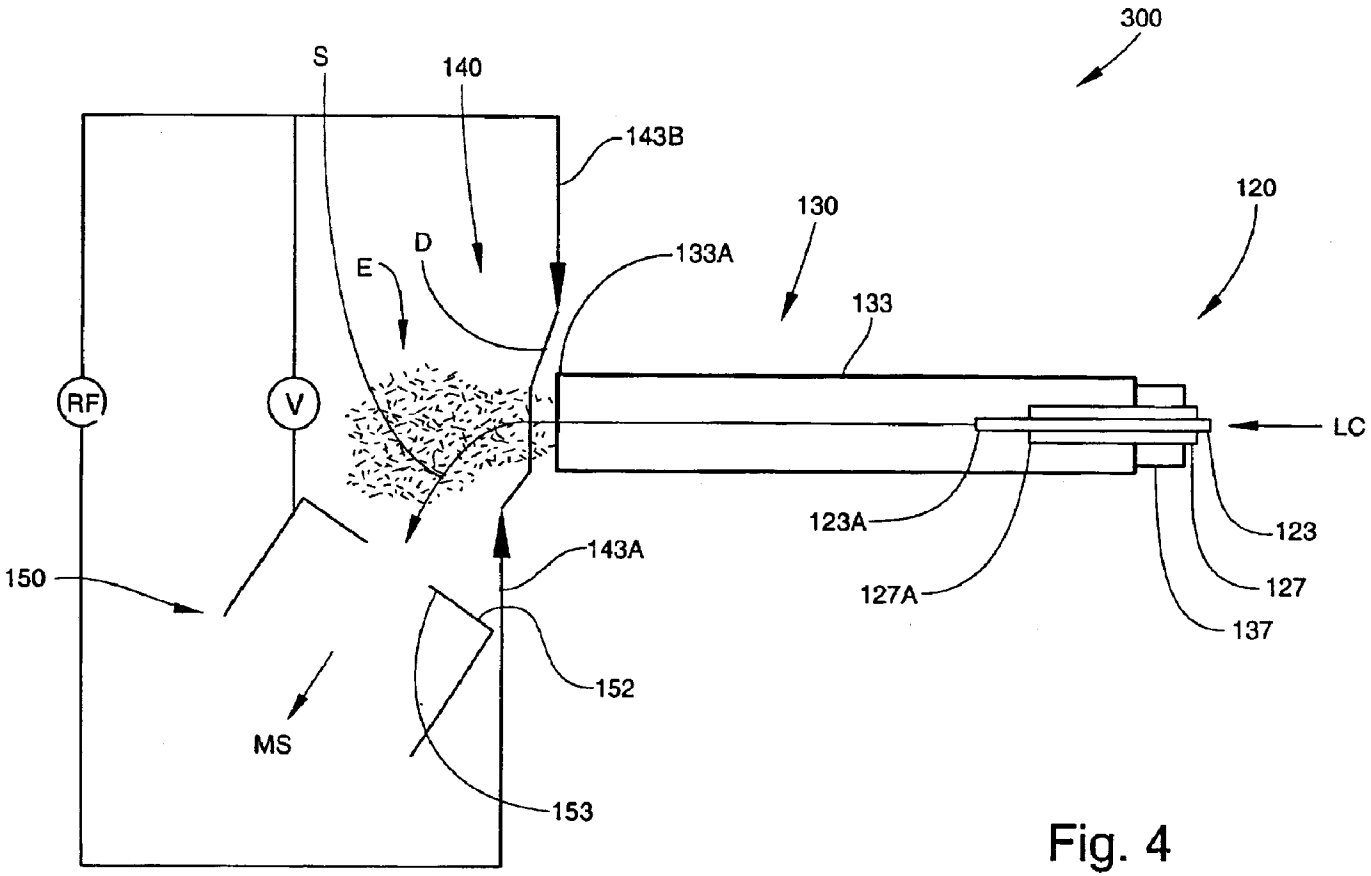
FIG. 4 is an axial cross-sectional schematic view of an APCI source in accordance with an alternative of the embodiment shown in FIG. 3B.

Referring now to FIG. 4, an APCI source, generally designated 300, is illustrated according to another embodiment that can be considered as a variation of APCI source 200 of FIGS. 3A and 3B. In the embodiment of FIG. 4, an RF generator RF is connected between electrodes 143A and 143B to form electrical discharge D at an RF frequency of, for example, approximately 10–1000 kHz. The application of an RF voltage to electrodes 143A and 143B instead of a DC voltage can provide better spatial stability and can support an "electrodeless" discharge, i.e., one in which the discharge does not contact electrodes 143A and 143B. As further shown schematically in FIG. 4, a DC potential is applied by a DC voltage source V or equivalent circuitry between one or both electrodes 143A and 143B and an electrically conductive portion of ion entry section 150 to direct the product ions toward ion sampling inlet 153. The superposition of the DC voltage on the alternating RF voltage can be accomplished by known circuitry means.

Figure 5:
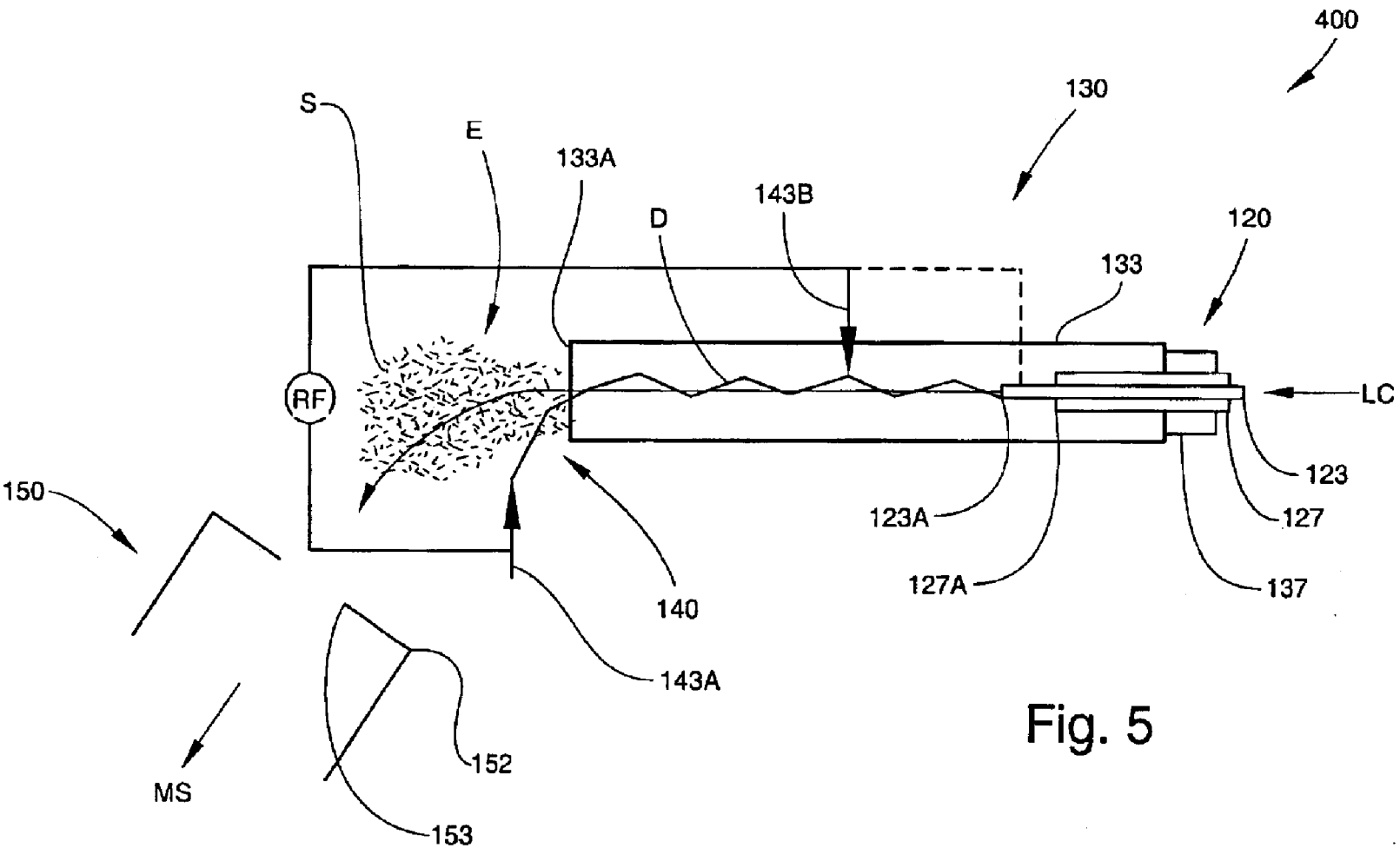
FIG. 5 is an axial cross-sectional schematic view of an APCI source provided in accordance with a further embodiment of the present invention.

Referring now to FIG. 5, an APCI source, generally designated 400, is illustrated according to another embodiment. An RF generator RF is connected between electrode 143A and counter-electrode 143B to form electrical discharge D, with at least a portion of electrical discharge D being formed within vaporizing tube 133. Counter-electrode 143B can be any structure having an electrical discharging surface disposed within vaporizing tube 133. As indicated by dashed and dotted lines in FIG. 5, an electrically conductive portion of nebulizing section 120 such as capillary tube 123 can serve as the counter-electrode, in which case electrical discharge D is coupled between electrode 143A and nebulizing section 120. Ion mobility toward ion sampling inlet 153 can be accomplished either by applying a DC potential between one of electrodes 143A and 143B and ion entry section 150 as shown in FIG. 4, or by employing an additional polarizing electrode 180 as shown for example in FIGS. 6A and 6B.

Figure 6A:
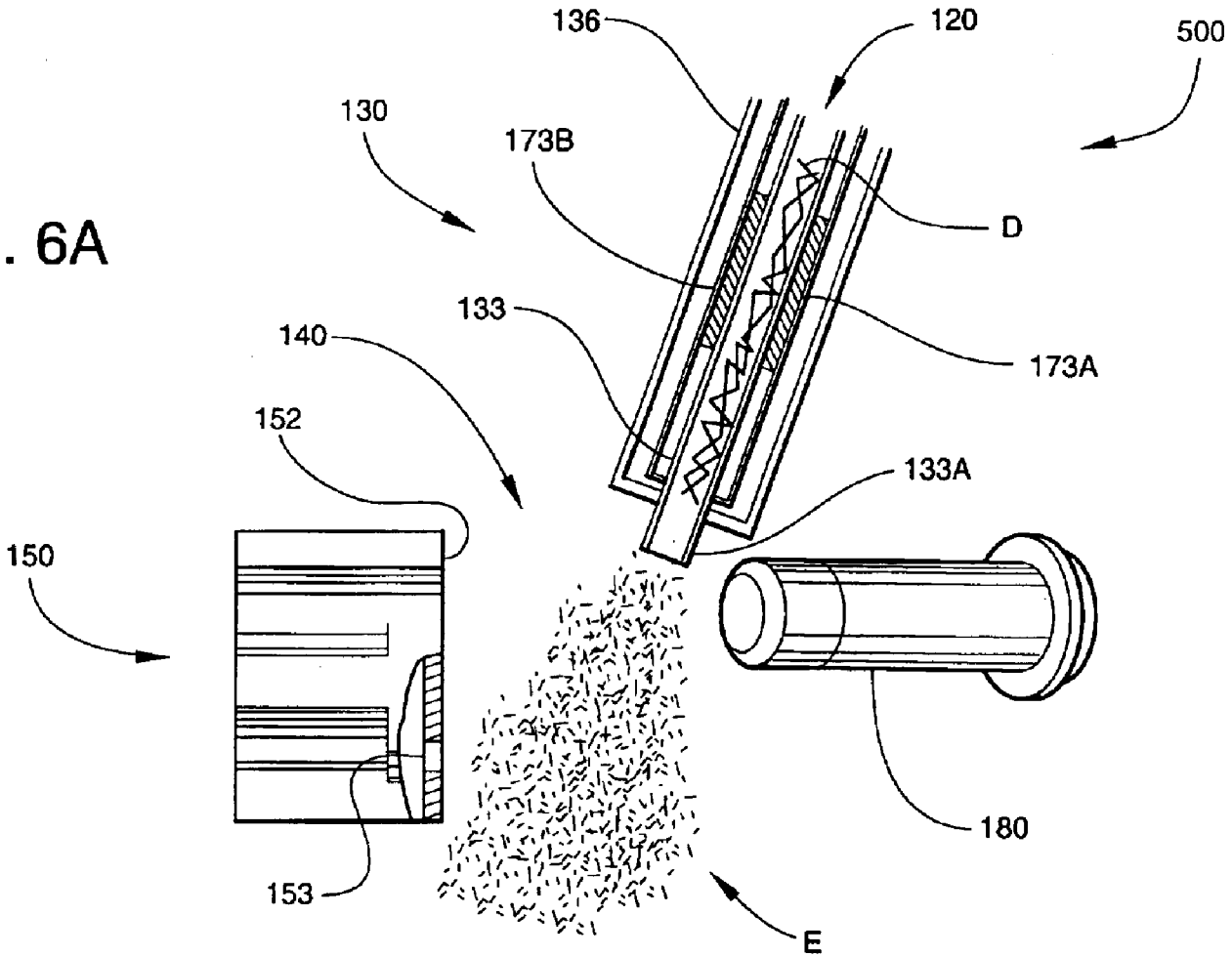
FIG. 6A is a perspective view of an APCI source provided in accordance with yet another embodiment of the present invention.
Figure 6B:
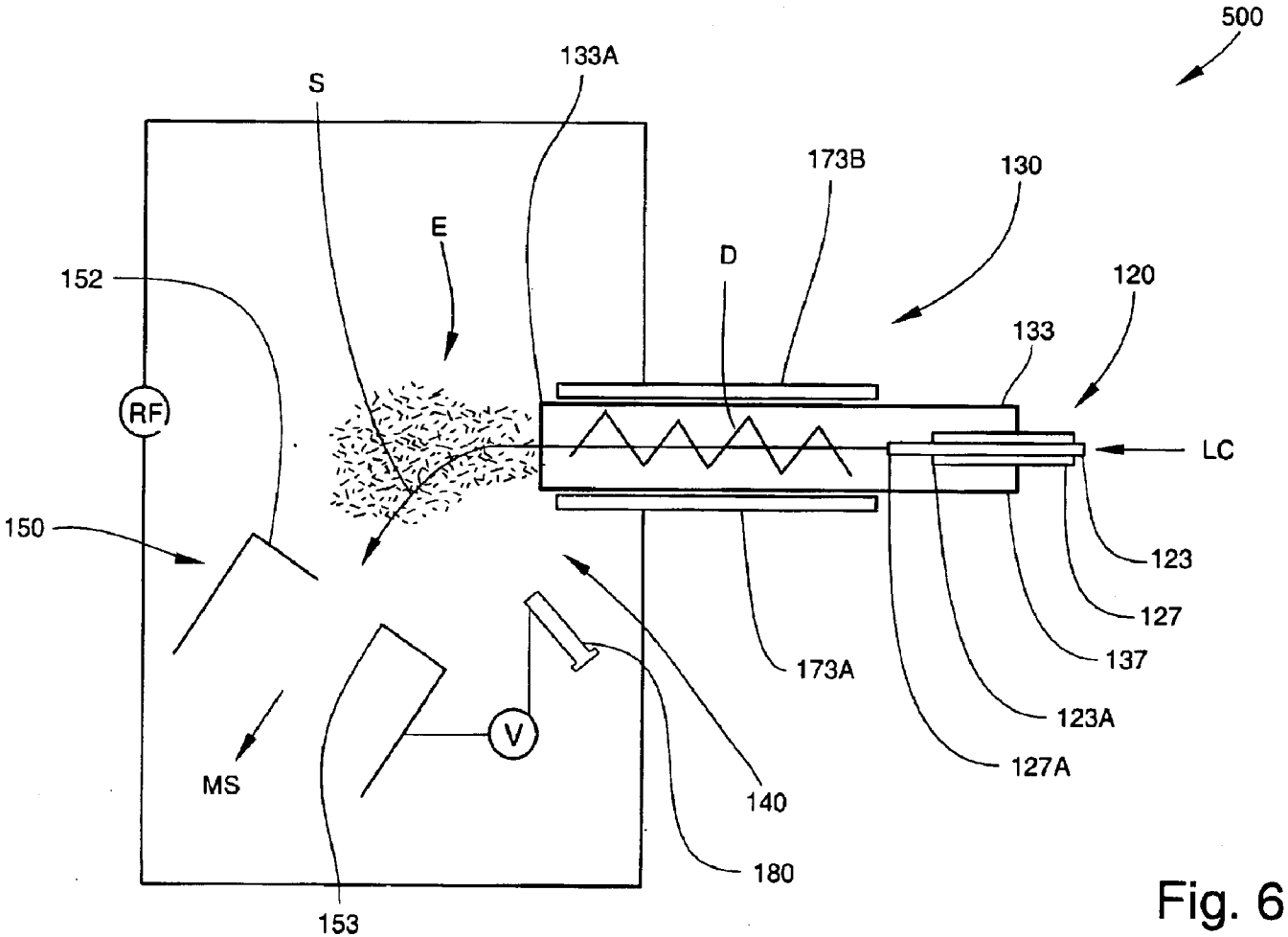
FIG. 6B is an axial cross-sectional schematic view of the APCI source shown in FIG. 6A.
Figure 6C:
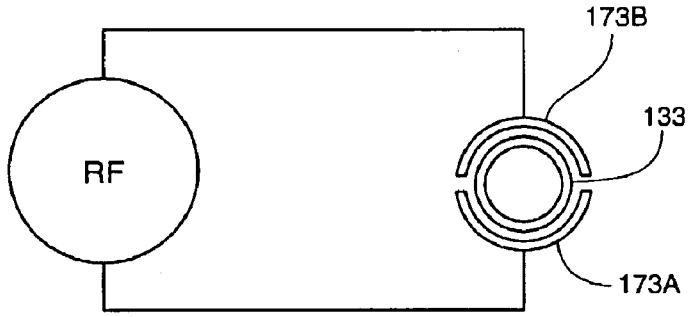
FIG. 6C is a transverse cross-sectional schematic view of the APCI source shown in FIG. 6A.

Referring now to FIGS. 6A and 6B, an APCI source, generally designated 500, is illustrated according to another embodiment. An electrode 173A and counter-electrode 173B are mounted outside of vaporizing tube 133 along a length thereof. As further shown in FIG. 6C, electrodes 173A and 173B generally conform to the shape of the outer surface of vaporizing tube 133, and thus can be provided in the form of a split cylinder. An RF generator RF connected between electrodes 173A and 173B is set to apply a high-frequency alternating RF voltage therebetween. This enables capacitive coupling between electrodes 173A and 173B across the wall of vaporizing tube 133, which typically is constructed from a dielectric material such as quartz. As a result, an electrode-less, high-frequency (for example, approximately 10–1000 kHz) RF discharge D is created entirely within vaporizing tube 133, and without the need for electrodes 173A and 173B to be directly exposed to the interior environment of vaporizing tube 133. Ionized products discharged from vaporizing tube outlet 133A are directed toward ion sampling inlet 153 by applying a DC potential between a polarizing electrode 180, located downstream from vaporizing tube 133, and ion entry section 150. By forming electrical discharge D as well as the resultant chemical ionization reagent ions entirely within vaporizing tube 133, the formation of background ions in ionization section 140 is avoided and the reaction volume available for the primary, intermediate, and in some cases the collision-dominated final reactions of APCI is increased. As a consequence, more sample ions are produced. As an additional advantage, because electrodes 173A and 173B are not directly exposed to discharge D and to the chemical environment in vaporizing tube 133 and ionization chamber 142 (schematically depicted as an enclosed volume in FIG. 2B, into which the contents of vaporizer tube 133 are exhausted through vaporizing tube outlet 133A), electrodes 173A and 173B are not contaminated during the operation of APCI source 500.

It will be understood that the APCI sources described herein can be configured so as to also be capable of performing ESI, with little or no modification or reconfiguration. The subject matter disclosed herein is applicable to LC-API-MS systems in general. It will also be understood that various operating parameters for the APCI systems disclosed herein, such as effluent and gas flow rates, fluid pressures and temperatures, voltages and currents, solvent composition, and so on will depend on the nature of the sample to be mass analyzed among other factors. As a general matter, it is known that optimization of operating parameters is less critical for APCI interfaces as compared with ESI interfaces.

In the operation of one or more of the embodiments disclosed herein, some ionization may occur as a result of ion ejection, which is the dominant ionizing mechanism in ESI interfaces. This is particularly true when the sample solution contains highly polar or ionic analytes. Moreover, in the case of moderately polar and/or non-volatile analytes, some ionization may occur as a result of the triboelectric effect, in which an electric charge is generated by the shearing action of the nebulizing process.

It will be further understood that various details of the invention may be changed without departing from the scope of the invention. Furthermore, the foregoing description is for the purpose of illustration only, and not for the purpose of limitation—the invention being defined by the claims.

What is claimed is:

1. An apparatus for use as an ion source for mass analysis, comprising:

(a) a nebulizing device for nebulizing a flowing sample;

(b) a vaporizing device for vaporizing the sample flowing from the nebulizing device, the vaporizing device comprising a vaporizing interior terminating at a vaporizing device outlet;

(c) a chamber fluidly communicating with the vaporizing device outlet;

(d) an ion sampling structure having an ion sampling inlet fluidly communicating with the chamber and spaced from the vaporizing device outlet; and (e) an ionizing device comprising first and second electrodes positioned to produce an electrical discharge therebetween at a location closer to the vaporizing device outlet than to the ion sampling inlet.

2. The apparatus according to claim 1, wherein the first electrode is positioned in the chamber in close proximity to the vaporizing device outlet.

3. The apparatus according to claim 2, wherein the second electrode is disposed within the vaporizing interior for producing an electrical discharge extending into the vaporizing interior through the vaporizing device outlet.

4. The apparatus according to claim 3, wherein the second electrode comprises an electrically conductive portion of the nebulizing device.

5. The apparatus according to claim 3, wherein the second electrode comprises an electrically conductive portion of the vaporizing device.

6. The apparatus according to claim 2, wherein the second electrode is positioned in the chamber in close proximity to the vaporizing device outlet, and the first and second electrodes are oriented on opposite sides of the vaporizing device outlet for producing an electrical discharge traversing a sample exhaust flow from the vaporizing device outlet.

7. The apparatus according to claim 1, wherein the first and second electrodes are disposed along an axial length of the vaporizing device outside of the vaporizing interior and are coupled by an AC voltage for producing an electrical discharge substantially entirely within the vaporizing interior.

8. The apparatus according to claim 7, wherein the AC voltage is an RF voltage source.

9. The apparatus according to claim 7, comprising a polarizing electrode disposed in the chamber for establishing an electric field in the chamber by which ionized sample components can be directed toward ion sampling inlet.

10. The apparatus according to claim 1, wherein the first and second electrodes are positioned in non-contacting relation to a sample exhaust flow from the vaporizing device outlet.

11. An apparatus for use as an ion source for mass analysis, comprising:

(a) a nebulizing device for nebulizing a flowing sample;

(b) a vaporizing device for vaporizing the sample flowing from the nebulizing device, the vaporizing device comprising a vaporizing interior terminating at a vaporizing device outlet;

(c) a chamber fluidly communicating with the vaporizing device outlet;

(d) an ion sampling structure having an ion sampling inlet fluidly communicating with the chamber and spaced from the vaporizing device outlet; and (e) an ionizing device comprising an electrode disposed in the chamber for creating an electrical discharge between the electrode and an electrically conductive component disposed in the vaporizing interior.

12. The apparatus according to claim 11, wherein the conductive component is a conductive portion of the nebulizing device.

13. The apparatus according to claim 11, wherein the conductive component is a conductive portion of the vaporizing device.

14. The apparatus according to claim 11 comprising a DC voltage source connected between the electrode and the conductive component.

15. The apparatus according to claim 11 comprising an RF voltage source connected between the electrode and file conductive component.

16. The apparatus according to claim 11, comprising a DC voltage source connected between the electrode and the ion sampling structure for establishing an electric field for directing sample ions toward the ion sampling inlet.

17. A method for ionizing sample molecules at atmospheric pressure, comprising the steps of:

(a) flowing a nebulized sample through an interior of a vaporizing device to vaporize the sample;

(b) exhausting the vaporized sample through an outlet of the vaporizing device into a chamber, wherein an ion sampling inlet is disposed in the chamber and spaced from the vaporizing device outlet; and (c) ionizing the sample by forming an electrical discharge at a location closer to the vaporizing device outlet than to the ion sampling inlet.

18. The method according to claim 17, wherein at least a portion of the electrical discharge is directed through the vaporizing device outlet into the vaporizing device interior to initiate ionizing reactions prior to the sample being exhausted into the chamber.

19. The method according to claim 17, wherein the sample is exhausted into the chamber in a sample exhaust stream, and the electrical discharge traverses the sample exhaust stream immediately downstream from the vaporizing device outlet, whereby the sample becomes ionized immediately after being exhausted from the vaporizing device outlet.

20. The method according to claim 17, wherein the electrical discharge is formed substantially entirely within the vaporizing device interior to initiate ionizing reactions prior to the sample being exhausted into the chamber.

21. The method according to claim 20, wherein forming the electrical discharge comprises driving first and second electrodes disposed outside of the vaporizing device interior to an RF voltage across a wall of the vaporizing device defining the vaporizing device interior.

* * * * *